US005762019A

United States Patent [19]

O'Rourke et al.

[11] Patent Number: 5,762,019

[45] Date of Patent: Jun. 9, 1998

[54] PERSONAL WATERCRAFT SURFACE PROTECTOR

[76] Inventors: Daniel Craig O'Rourke; Cynthia Ann O'Rourke, both of 4604 Green Valley, Jefferson City, Mo. 65109

[21] Appl. No.: 709,122

[22] Filed: Sep. 9, 1996

[51] Int. Cl.[6] ..... B63B 17/00

[52] U.S. Cl. ..... 114/361; 150/166

[58] Field of Search ..... 114/361, 219, 114/343; 150/154, 166, 168; 296/95.1, 136; 4/581, 582, 583

[56] References Cited

U.S. PATENT DOCUMENTS

| | | | |
|---|---|---|---|
| D. 297,627 | 9/1988 | Patton | D12/168 |
| 2,044,407 | 6/1936 | Smith | 4/582 |
| 4,586,451 | 5/1986 | Mori | 114/343 |
| 4,815,412 | 3/1989 | Cassaro, Jr. | 114/343 |
| 4,922,849 | 5/1990 | Wills | 114/361 |
| 5,291,848 | 3/1994 | Wilhelm et al. | 114/361 |
| 5,355,822 | 10/1994 | Lemke | 114/219 |
| 5,394,821 | 3/1995 | Ziegler et al. | 114/219 |
| 5,564,358 | 10/1996 | Newton | 114/361 |

*Primary Examiner*—Sherman Basinger

*Attorney, Agent, or Firm*—John D. Douglietta; David L. Volk

[57] ABSTRACT

A personal watercraft surface protector is provided for protecting the top front portion of personal watercraft. Designed to be an accessory to be used with the many models made by various manufacturers, the protector is molded into an overall cup-like shape in order to fit over the nose of a personal watercraft. The protector is formed of a plurality of layers, having a center protective layer formed of a single molded piece of impact absorbing material, such as rubber, having a plurality of suction cups formed integral to and extending downward from the center protective layer. The suction cups cover the inner lining of the protector for temporarily affixing the protector to the outer surface of a personal watercraft. An outer decorative layer and a smooth, scratch resistant inner layer are also provided.

9 Claims, 2 Drawing Sheets

PERSONAL WATERCRAFT SURFACE PROTECTOR

BACKGROUND OF THE INVENTION

1. Field of the Invention

The present invention relates generally to vehicle surface protectors and, more particularly, to a body surface protector for use with personal watercraft.

2. Description of the Related Art

Personal watercraft, as they are generically known, have become immensely popular in recent years. A major problem associated with demanding use of such water vehicles is that the top and front of the craft can incur scrapes and nicks when docked. In addition to protection from abrasions, protection from moderate impact would increase the longevity of the craft and its looks, thereby increasing resale value.

In the related art, other methods of protecting the outer hull surface of water vehicles are known. For example, in U.S. Pat. No. 5,394,821, issued in the name of Ziegler et al., a protective covering for a watercraft is disclosed for completely circumscribing the upper portion of the hull of a boat. And, in U.S. Pat. No. 5,355,822, issued in the name of Lemke, a bumper fender is disclosed depicting a portable cushion for movably placing between a dock and a boat. Similarly, in U.S. Des. Pat. No. 297,627, issued in the name of Patton, a boat bumper is disclosed appearing to function in a similar manner.

Further, there are also examples of protective devices for protecting the upper surface of a water vehicle. Examples include U.S. Pat. No. 4,922,849, issued in the name of Wills, and U.S. Pat. No. 4,815,412, issued in the name of Cassaro, Jr.

And finally, there has been one known attempt to partially protect both the outer surface as well as the upper surface of a water vehicle. In U.S. Pat. No. 5,291,848, issued in the name of Wilhelm et al., a protective boat hood is disclosed.

Consequently, a need has been felt for providing an apparatus which combines the benefits of protecting both the outer front surface as well as the upper front surface of a water vehicle other than a boat, namely a personal watercraft.

SUMMARY OF THE INVENTION

It is therefore an object of the present invention to provide an improved body surface protector for personal watercraft.

It is a feature of the present invention to provide an improved surface protector for personal watercraft which utilizes suction cups on the underside for securing the protector to the watercraft.

Briefly described according to the preferred embodiment of the present invention, a protective cover for the top front portion of personal watercraft is provided. Designed to be an accessory to be used with the many models made by various manufacturers, the protector would appear similar to the bras available for the front ends of sports cars. As a single molded piece including body-hugging curves, holes are provided to accommodate the rope hole located in the front of these vessels. On the underside, suction cups provide an easy way to secure it as well as easy removal.

An advantage of the present invention is that personal watercraft can be protected from the nicks and abrasions which occur when docking.

Another advantage of the present invention is that the craft is also protected from impact, sunlight, and the elements.

Further, a preferred embodiment of the present invention can be made in various colors, designs and textures for adding a sporty appeal to the craft.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
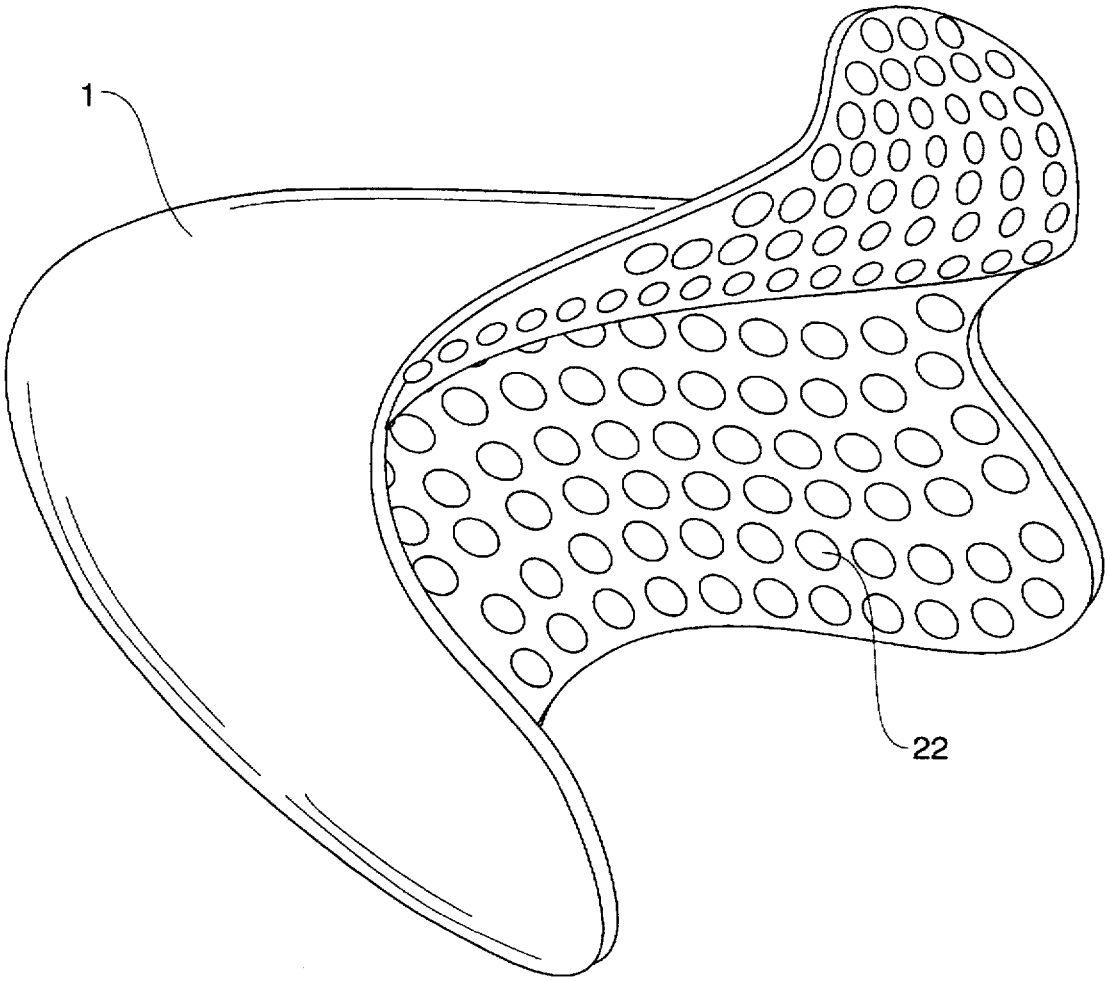
FIG. 1 is a perspective view of a personal watercraft surface protector according to the preferred embodiment of the present invention.

Referring now to FIG. 1, a personal watercraft surface protector 1 is shown, according to the present invention, for protecting the top front portion of personal watercraft. Designed to be an accessory to be used with the many models made by various manufacturers, the protector 1 is molded into an overall cup-like shape in order to fit over the nose of a personal watercraft. A universal shape can be utilized in order to provide a generic fit for all brands and types of watercraft, or a customized shape can be developed for each individual make and model. Overall, the protector would appear similar to the bras available for the front ends of sports cars.

Figure 2:
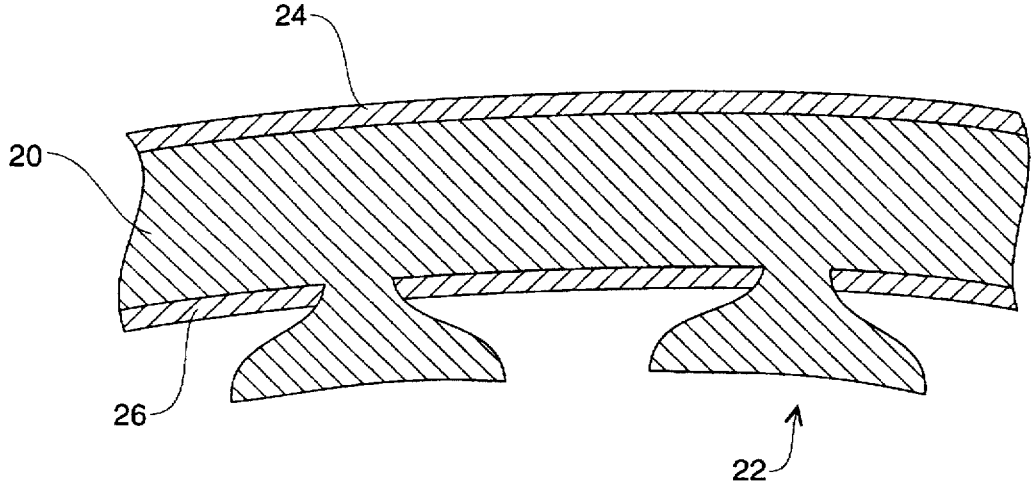
FIG. 2 is a cross sectional view thereof.
Figure 3:
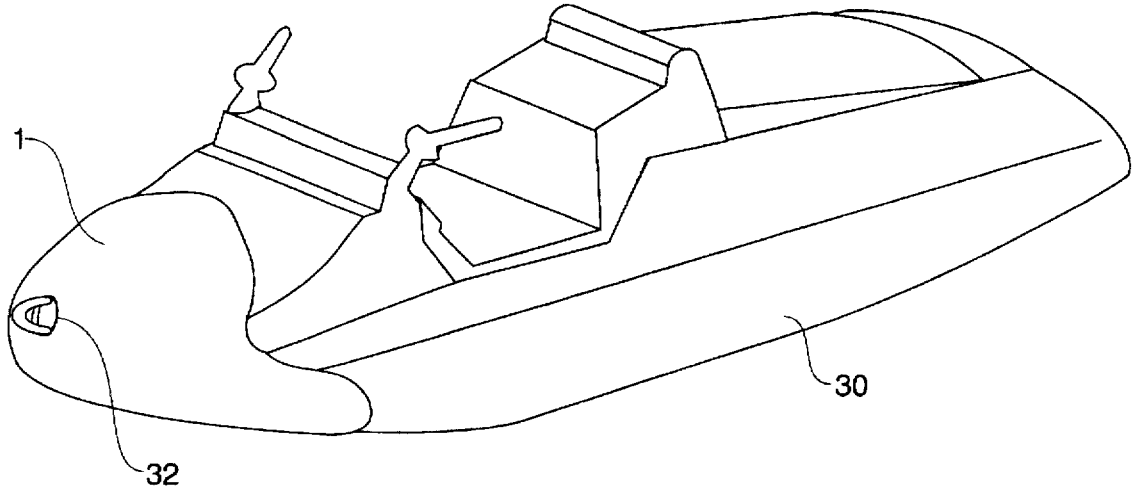
FIG. 3 is a perspective view thereof depicting the present invention install upon a personal watercraft.

As shown in FIG. 2, the protector 1 is formed of a plurality of layers. A center protective layer 20 is formed of a single molded piece of impact absorbing material, such as rubber. Formed integral to and extending downward from the center protective layer 20 are a plurality of suction cups 22. These suction cups 22 cover the inner lining of the protector 1, and form the attachment means for temporarily affixing the protector 1 to the outer surface of a personal watercraft 30 (as shown in FIG. 3.) Covering the outer surface of the center protective layer 20 is an outer decorative layer 24. It is envisioned that the outer decorative layer 24 comprises a polyurethane or other smooth, colorful, decorative material. The outer layer 24 is adhered directly to the outer surface of the center layer 20. A smooth, scratch resistant inner layer 26 is affixed to the inner surface of the center protective layer 20, and provides a scratch resistant lining. In order for the suction cups 22 to be able to adhere to the surface of the personal watercraft properly, the suction cups 22 must protrude through the inner layer 26.

2. Operation of the Preferred Embodiment

In accordance with a preferred embodiment of the present invention, as shown in FIG. 3, the protector 1 is slipped over the nose of a personal watercraft 30. In order to facilitate adhesion of the suction cups 22 to the watercraft 30, the protector 1 can be wetted prior to attachment. Removal of the protector 1 is accomplished by slowly and gently disengaging the suction cups 22 from the surface of the watercraft 30 so as to avoid tearing or stretching the material. As depicted, it is envisioned that access apertures 32 would be provided, depending upon the specific needs of the user's personal watercraft 30, such as to provide access for docking lugs, towing hooks, or the like.

The foregoing description is included to illustrate the operation of the preferred embodiment and is not meant to limit the scope of the invention. It would be obvious to one of ordinary skill that many minor variations can be performed to the present invention within the scope of the present teachings. Therefore, the scope of the invention is to be limited only by the following claims.

What is claimed is:

1. A personal watercraft surface protector having an overall cup-like shape in order to fit over the nose of a personal watercraft for protecting the top front portion of personal watercraft, said protector comprising:

a center protective layer having an inner surface and an outer surface;

a plurality of suction cups formed integral to and extending downward from said center protective layer, said suction cups thereby covering said inner surface and thereby forming attachment means for temporarily affixing said protector to the outer surface of a personal watercraft;

an outer decorative layer covering said outer surface of said center protective layer; and a smooth, scratch resistant inner layer affixed to the inner surface of the center protective layer for providing a scratch resistant lining, and wherein said suction cups protrude through said inner layer.

2. The personal watercraft surface protector as described in claim 1, wherein said center protective layer is formed of a single molded piece of impact absorbing material.

3. The personal watercraft surface protector as described in claim 2, wherein said impact absorbing material is rubber.

4. The personal watercraft surface protector as described in claim 1, wherein said outer layer is adhered directly to the outer surface of the center layer.

5. The personal watercraft surface protector as described in claim 1, further comprising access apertures penetrating through and formed by said protector, said access apertures for provide access for docking lugs or towing hooks.

6. In a vehicle surface protector having a center protective layer having an inner surface and an outer surface, an outer decorative layer covering said outer surface of said center protective layer; and a smooth, scratch resistant inner layer affixed to the inner surface of the center protective layer for providing a scratch resistant lining, wherein the improvement comprises:

said protector having an overall cup-like shape in order to fit over the nose of a personal watercraft for protecting the top front portion of a personal watercraft; and a plurality of suction cups formed integral to and extending downward from said center protective layer and wherein said suction cups protrude through said inner layer, said suction cups thereby covering said inner surface and thereby forming attachment means for temporarily affixing said protector to the outer surface of a personal watercraft.

7. The vehicle surface protector as described in claim 6, wherein said center protective layer is formed of a single molded piece of impact absorbing material.

8. The vehicle surface protector as described in claim 7, wherein said impact absorbing material is rubber.

9. In the vehicle surface protector as described in claim 6, wherein the improvement further comprises access apertures penetrating through and formed by said protector, said access apertures for providing access for docking lugs or towing hooks.

* * * * *